United States Patent [19]

Bertram et al.

[11] Patent Number: 4,982,771

[45] Date of Patent: Jan. 8, 1991

[54] PARTICULATE MATERIAL COLLECTION BOTTLE FOR REPRODUCTION APPARATUS

[75] Inventors: Gary B. Bertram, Honeoye Falls; James A. McGlen, Rochester, all of N.Y.

[73] Assignee: Eastman Kodak Company, Rochester, N.Y.

[21] Appl. No.: 438,815

[22] Filed: Nov. 20, 1989

[51] Int. Cl.[5] ..... B65B 1/04; G03G 15/06

[52] U.S. Cl. ..... 141/312; 141/370; 355/260

[58] Field of Search ..... 355/260, 298; 141/312, 141/360, 370, 372; 222/DIG. 1; 206/316.1, 316.2, 316.3

[56] References Cited

U.S. PATENT DOCUMENTS

| | | | |
|---|---|---|---|
| 4,611,730 | 9/1986 | Ikesue et al. | 222/DIG. 1 |
| 4,801,972 | 1/1989 | Kusumoto et al. | 355/326 X |
| 4,870,463 | 9/1989 | Miyoshi et al. | 118/653 |

FOREIGN PATENT DOCUMENTS

| | | | |
|---|---|---|---|
| 0101979 | 8/1980 | Japan | 355/298 |
| 0170882 | 9/1985 | Japan | 355/298 |
| 0117584 | 6/1986 | Japan | 355/298 |

*Primary Examiner*—A. T. Grimley
*Assistant Examiner*—Nestor R. Ramirez
*Attorney, Agent, or Firm*—Leonard W. Treash, Jr.

[57] ABSTRACT

A particulate material collection bottle for a reproduction apparatus includes an opening for receiving a tube through which particulate material is fed. A detent at the opposite end of the bottle from the opening fits in a complementary detent in the receiving apparatus to wedge the bottle between the detent and the tube. To permit the opening to receive a barb on the tube it is oblong in shape and has a compressible seal around its exterior. Recessed rib portions of opposing side walls form a handle to assist insertion of the bottle in the apparatus. A projection from one wall of the apparatus is positioned to activate a sensing means to indicate the presence of the bottle in its appropriate position. A foldable paper seal is positioned below the opening. It can be folded across the opening after a full bottle has been removed.

3 Claims, 2 Drawing Sheets

PARTICULATE MATERIAL COLLECTION BOTTLE FOR REPRODUCTION APPARATUS

TENCHINCAL FIELD

This invention relates to a bottle for collecting particulate material, such as toner, in a reproduction apparatus. For example, the invention relates to toner collection bottle attachabl to the cleaning station of an electrophotographic copier or printer.

BACKGROUND OF THE INVENTION

Copiers and printers in which electrostatic images are developed by dry particulate toner commonly have one or more cleaning stations. These cleaning stations clean toner and sometimes carrier or paper particles off surfaces on which such particles are unwanted. Most commonly, toner and some carrier is cleaned off a photoconductive surface after most of a toner image has been transferred. Particles are also cleaned off the backs of photoconductive members and off transfer surfaces. Although some apparatus recycle cleaned toner, most apparatus merely collects the cleaned particulate material for disposal by a service person. One type of commonly used cleaning station uses an auger to feed cleaned particulate material from the cleaning device itself into a collection container. The service person must empty or dispose of the container periodically.

Loose toner readily becomes airborne and seriously affects the operation of many components in such apparatus. For example, the optical system is particularly adversely affected by airborne toner. Further, the preson and clothing of an operator or service person is readily soiled by vagabond toner.

In the modern copier and printer marketplace the expense, convenience and reliability associated with service may be the most critical ingredient contributing to total customer satisfaction.

STATEMENT OF THE INVENTION

It is an object of the invention to provide a bottle for collecting particulate material in a reproduction apparatus, which reproduction apparatus has a tube of generally circular cross section through which particulate material is fed, for example, by an auger, and which collection bottle is easily removed and inserted in the apparatus with minimal danger of the escape of toner.

This and other objects are accomplished by providing a toner collection bottle which has a bottom wall with a detent which is cooperable with a detent in the receiving apparatus. Side walls to the bottle extend upward from the bottom wall to a top portion. The top portion includes an opening in a first of the side walls for receiving the tube of the apparatus. The bottle is wedgeable between the tube and the apparatus detent.

With this bottle the operator merely places the opening in the top portion over the tube and wedges the detent in the bottom into the detent in the apparatus to insert the bottle readily in the apparatus.

According to a preferred embodiment the opening in the top portion of the bottle is oblong in shape to readily receive a barb on the receiving tube. A compressible seal surrounds the opening. When inserted on the apparatus the compressible seal surrounding the opening and the first wall are pressed between the bard and a flange on the apparatus receiving tube. With this structure toner is unlikely to escape in the process of being deposited in the bottle.

Acccording to another preferred embodiment a paper seal is provided on the first wall of the bottle. After removal of the bottle from the apparatus the paper seal may be folded upwards to cover the oblong opening.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
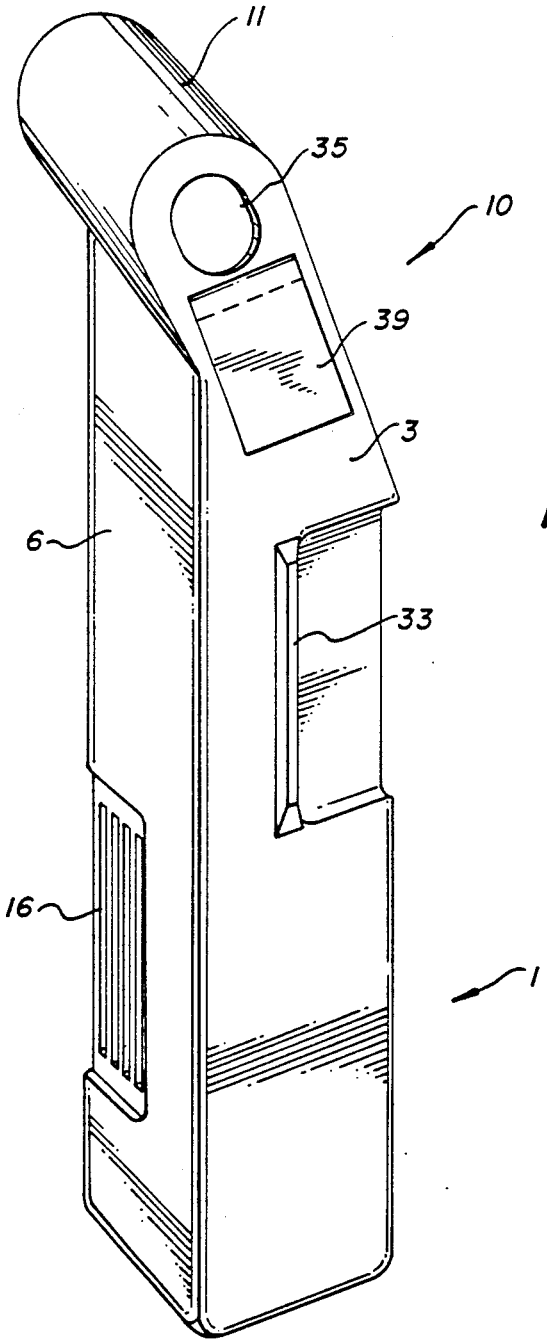
FIG. 1 is a prespective view of a particulate material collection bottle constructed according to the invention.
Figure 3:
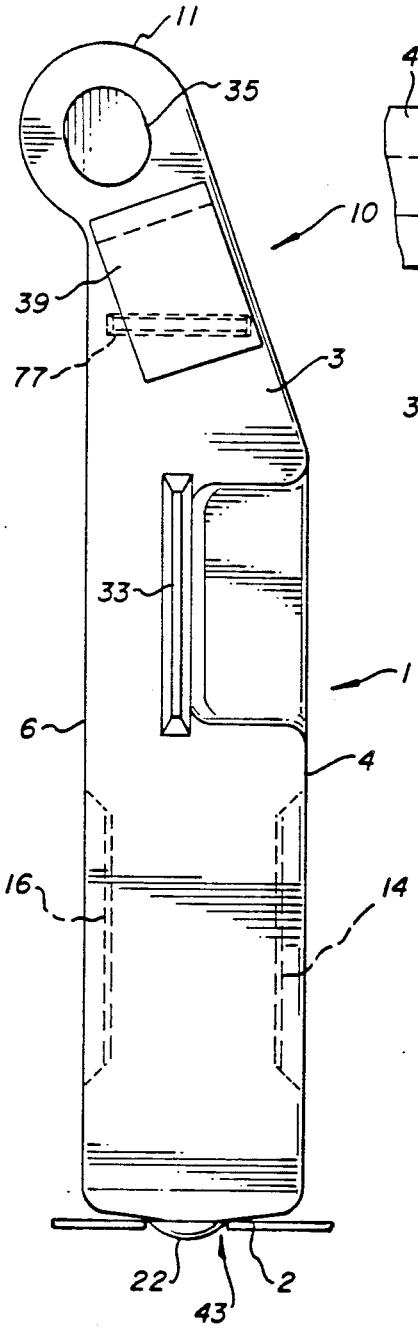
FIG. 3 is a front view of the particulate material collection bottle with some features shown in phantom.
Figure 2:
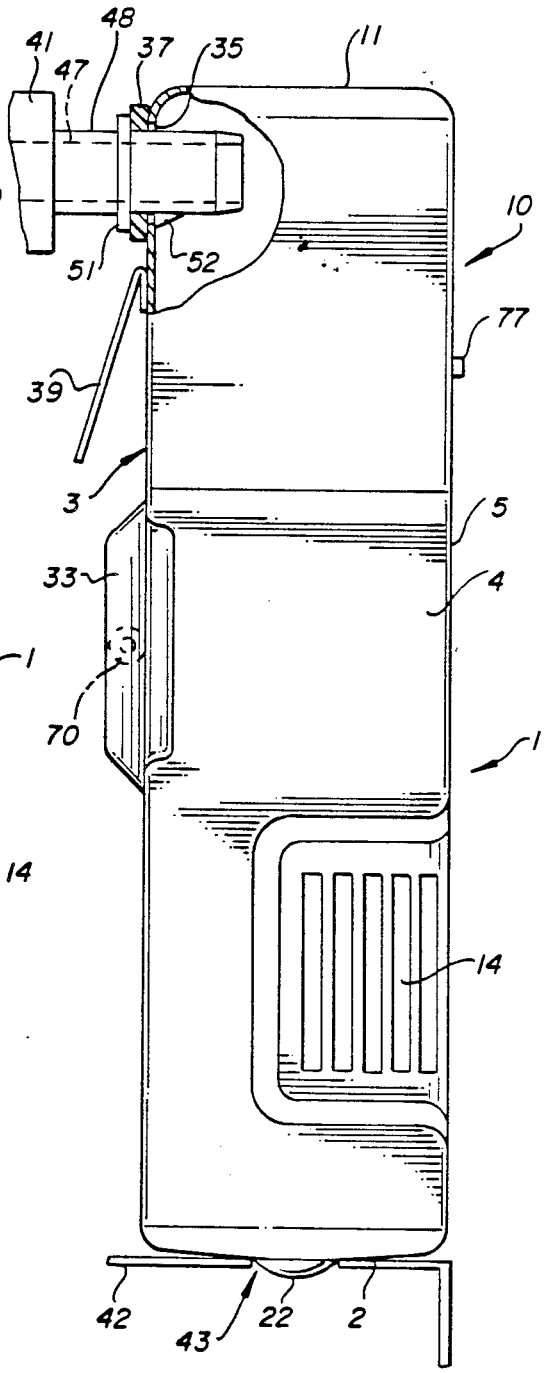
FIG. 2 is a side view of the toner collection bottle with a portion broken away to illustrate its cooperation with a receiving apparatus.

According to FIGS. 1–3, a particulate material collection bottle 1 includes a rectangular bottom wall 2 and first, second, third, and fourth side walls 3, 4, 5 and 6 extending upward from the bottom wall 2 to a top portion 10. The top portion 10 is closed by a rounded top wall 11.

Opposite side walls 4 and 6 have ribbed recesses 14 and 16 which form a handle or grip to assist the operator or service person in installing and removing the bottle.

The bottom wall 2 includes a protruding detent 22. The first side wall 3 has a protrusion 33, positioned to intercept an optical sensing device 70 in the apparatus to indicate that the bottle is present and in its proper position.

First side wall 3 also has means defining an opening 35 through which particulate material is fed when the toner bottle is in position in a receiving apparatus. Opening 35 is oblong in shape and is surrounded by a circular cross section compressible seal 37, shown only in FIG. 2.

A folded paper seal 39 is fastened by adhesive below the opening 35.

The bottle is received in a reproduction apparatus which includes a cleaning station 41 which is properly spaced from a bottle support member 42 having a detent 43. The cleaning station 41 includes an auger 47, shown in phantom in FIG. 2. The auger is enclosed by a tube 48 through which the auger feeds particulate material from cleaning station 41. To aide in supporting bottle 1 the tube 48 has a flange 51 and a barb 52.

As best seen in FIG. 2, bottle 1 is inserted in the reproduction apparatus by inserting opening 35 over tube 48 with tube 48 compressing the top portion of compressible seal 37 as barb 52 rides on the lower portion of opening 35 until barb 52 is seated inside of first wall 3. In the same motion the bottom wall 2 with detent 22 is pushed across bottle support member 42 until bottle detent 22 rests comfortably in apparatus detent 43 to wedge the bottle between detent 43 and tube 48. The first wall 3 around opening 35 and the seal 37 fit tightly between barb 52 and flange 51 to securely seal the opening 35 the end of tube 48 from the escape of particulate material.

When the bottle is in position as shown in FIG. 2 protrusion 33 intersects a light beam projected onto optical sensing device 70, shown schematically in FIG. 2, to open a circuit thereby indicating that the bottle is in position.

Insertion of the bottle is made convenient by the location of ribbed recesses 14 and 16 which are gripped by the operator or service person.

The bottle is removed when full. That can be indicated by an appropriate optical sensing means, not shown. Alternatively, the bottle can be made out of transparent or translucent plastic. A "full" line 77 on wall 5 can be used by the operator to visually determine that the bottle should be changed. Alternatively, the bottle can be made of an appropriate size to require replacement consistent with other portions of the apparatus which can be programmed to never involve overfilling the bottle.

When the bottle is removed the operator again grips recessed ribbed areas 14 and 16 and pulls the bottle downward and to the right to release it from the barb and remove it from both detent 22 and tube 48. After the bottle has been removed from tube 48 paper seal 39 is unfolded upwards and sealed over opening 35.

Bottom wall 2 is angled as shown in both FIGS. 2 and 3 to assist in positioning detent 22 in detent 43 in bottle holding member 42.

The invention has been described in detail with particular reference to a preferred embodiment thereof, but it will be understood that variations and modifications can be effected within the spirit and scope of the invention as described hereinabove and as defined in the appended claims.

We claim:

1. A bottle of collecting particulate material in a reproduction apparatus, which reproduction apparatus has a tube of generally circular cross section through which particulate material is fed and a recessed detent spaced below said tube, said bottle comprising:

a bottom wall having a an integrally formed detent cooperable with the recessed detent in said apparatus, said bottom wall detent consisting of a generally centrally located externally directed protrusion from said bottom wall, side walls extending away from said bottom wall to a top portion, said bottom wall being angled from said protrusion to at least one of said side walls to permit engagement of said bottom wall detent with said recessed detent, means defining an opening in the first of said side walls in said top portion for receiving the tube of a receiving reproduction apparatus with said bottle being wedgeable between the tube and said detent of the receiving apparatus as permitted by said angled bottom wall.

2. A bottle according to claim 1 for use with a reproduction apparatus in which apparatus the tube has a barb on its bottom surface and a flange spaced from the barb, said bottle being characterized in that the opening in the bottle is oblong to permit said opening to receive the barb with the bottom wall of the bottle pivoted away from the recessed detent, the lower edge of said oblong opening being spaced from the bottom wall a distance forcing said lower edge to a position between the flange and the barb to secure said bottle when said bottom wall is pivoted to engage the recessed detent.

3. A bottle according to claim 2 having second, third and fourth opposing side walls, opposite portions of the second and fourth side walls adjacent the third wall being ribbed to form a handle for pivoting said bottle around the upper edge of said opening.

* * * * *